US009620093B2

(12) United States Patent
Velez-Gallego

(10) Patent No.: US 9,620,093 B2
(45) Date of Patent: Apr. 11, 2017

(54) SIMPLE MUSIC—NEXT GENERATION KEYBOARD

(71) Applicant: Juan Carlos Velez-Gallego, Hatillo, PR (US)

(72) Inventor: Juan Carlos Velez-Gallego, Hatillo, PR (US)

( * ) Notice: Subject to any disclaimer, the term of this patent is extended or adjusted under 35 U.S.C. 154(b) by 0 days.

(21) Appl. No.: 14/872,052

(22) Filed: Sep. 30, 2015

(65) Prior Publication Data

US 2016/0232883 A1 Aug. 11, 2016

Related U.S. Application Data

(60) Provisional application No. 62/058,579, filed on Oct. 1, 2014.

(51) Int. Cl.
*G10H 1/34* (2006.01)

(52) U.S. Cl.
CPC ..... *G10H 1/34* (2013.01); *G10H 1/344* (2013.01); *G10H 2220/251* (2013.01)

(58) Field of Classification Search
CPC ..... G10H 1/34; G10D 11/00
See application file for complete search history.

(56) References Cited

U.S. PATENT DOCUMENTS 370,218 A * 9/1887 Stratton ..... G10D 11/00 84/376 R
1,659,414 A * 2/1928 Pitt-Taylor ..... G10D 11/00 84/376 K (Continued)

*Primary Examiner* — Robert W Horn

(57) ABSTRACT

Musical instruments are circumscribed to their physical boundaries. They produce sound through vibrations at different frequencies constraint by the instruments themselves. The representation of these frequencies, rather than geometrical and mathematically simple, is the result of very complex vibration patterns.

Some instruments get away with arranging individual notes to the player's convenience by the inclusion of multiple individual instruments within one body. The piano is a prominent example of an instrument with manipulated note architecture. It has an individual musical instrument for each sound although still circumscribed to a common body with its sound implications. However it follows a chromatic pattern, including consecutive series of each musical note according to its pitch rather than taking full advantage of its opportunity to translate the complex frequency behavior of notes into geometrical, visual patterns.

On the other hand, we introduce the Keyboard, an instrument intended to accommodate for the sound of most instruments, but still resembling the pattern of one of them, the piano. Like the piano, still forces players to separate their fingers by predetermined amount of spaces over other keys to obtain basic chords. Moreover, when trying to change the way the chords sound through changing their voicing, the fingers pattern changes widely. Not to mention, this happens even with the use of white keys only; it gets much more complicated when the black keys are incorporated into the musical play.

At present, there has been a tendency for technology and games to providing for people to feel like they are playing musical instruments, to mention, Guitar Hero, Wii Music, etc. People are eager to try these games as within most people there is a desired of understanding music and musical instruments but find themselves incapable of learning and developing instrument specific musical skills, especially as time goes by.

New Board of Keys patterns are proposed. These key patterns prioritize on the visualization and building of chords. Although with similitude to the keyboard in the sense of providing for pressing individual keys and to the guitar in the sense of allowing multiple instances of each particular note, they provide for a simplified way for com- (Continued)

mon people, on instances limited by time or abilities to further developing musical skills to use a visual, simple way of learning and playing music. Moreover, these new boards of keys provide for reapplying learned music patterns for any given key to every single music key, a feature rarely found in musical instruments.

8 Claims, 5 Drawing Sheets

(56) References Cited

U.S. PATENT DOCUMENTS 2,003,894 A * 6/1935 Luedtke ..... G10C 3/12 84/376 K
3,417,648 A * 12/1968 Honig ..... G10C 3/06 84/423 B
3,468,209 A * 9/1969 Barreto ..... G09B 15/06 84/376 K
4,031,800 A * 6/1977 Thompson ..... G10C 3/12 84/423 B
5,741,990 A * 4/1998 Davies ..... G09B 15/004 84/423 R
6,093,879 A * 7/2000 Pye ..... G10C 3/12 84/312 R
6,392,131 B2 * 5/2002 Boyer ..... G10D 13/085 84/424
6,444,888 B1 * 9/2002 VanDruff ..... G10H 1/20 84/423 R
6,501,011 B2 * 12/2002 Wesley ..... G10H 1/0066 84/600
6,670,535 B2 * 12/2003 Anderson ..... G10H 1/34 84/443
7,154,033 B2 * 12/2006 Mutou ..... G10C 3/12 84/423 R
7,273,979 B2 * 9/2007 Christensen ..... G10H 1/0066 200/512
7,394,010 B2 * 7/2008 Nishibori ..... G10H 1/06 84/464 A
8,173,884 B2 * 5/2012 Gatzsche ..... G10H 1/0008 84/615
8,614,384 B2 * 12/2013 Hotrique ..... G10C 3/12 84/376 R
8,822,803 B2 * 9/2014 Terry ..... G10H 1/34 84/644
8,987,573 B1 * 3/2015 Lippens ..... G09B 15/002 84/423 R
9,082,384 B1 * 7/2015 Cohen ..... G09B 15/023
9,159,307 B1 * 10/2015 Ludovici ..... G10H 1/0066
2009/0114078 A1 * 5/2009 Plamondon ..... G10H 1/34 84/423 R
2016/0232883 A1 * 8/2016 Velez-Gallego ..... G10H 1/34

* cited by examiner

Figure 1: Chromatic pattern of musical notes.

| NUMBER | 1 | 2 | 3 | 4 | 5 | 6 | 7 | 8 | 9 | 10 | 11 | 12 |
|---|---|---|---|---|---|---|---|---|---|---|---|---|
| NOTE | C | Db | D | Eb | E | F | Gb | G | Ab | A | Bb | B |

Figure 2: The Simple Music basic rows note sequence.

| STEP | ... | 0 | +4 | +3 | +4 | +3 | +4 | +3 | +4 | +3 | +4 | +3 | +4 | +3 | +4 | +3 | +4 | +3 | +4 | +3 | +4 | +3 | +4 | +3 | +4 | +3 | ... |
|---|---|---|---|---|---|---|---|---|---|---|---|---|---|---|---|---|---|---|---|---|---|---|---|---|---|---|---|
| NOTE | ... | C0 | E | G | B | D | F# | A | C# | E | G# | B | D# | F# | Bb | Db | F | Ab | C | Eb | G | Bb | D | F | A | C7 | ... |

Figure 3: The formation of alternating major and minor chords.

| CHORD | C | E | G | B | D | F# | A | C# | E | G# | B | D# | F# | Bb | Db | F | Ab | C | Eb | G | Bb | D | F | A |
|---|---|---|---|---|---|---|---|---|---|---|---|---|---|---|---|---|---|---|---|---|---|---|---|---|
| | C Major Chord | | | | | F# Minor Chord | | | | | | | | | | | Ab Major Chord | | | | | | | |

Figure 4: Resulting Major and Minor chords surrounding a key.

| | | | | |
|---|---|---|---|---|
| E | G | B | D | F# |
| F | A | C1 | E | G |
| G | Bb | D | F | A |

Figure 5: Combination of rows with +2, +1 semitones sequence top to bottom, as referenced on, but not limiting Claim #15.

| | | | | | | | | | | | | | | | | | | | | | | | | |
|---|---|---|---|---|---|---|---|---|---|---|---|---|---|---|---|---|---|---|---|---|---|---|---|---|
| C0 | E | G | B | D | F# | A | C# | E | G# | B | D# | F# | Bb | Db | F | Ab | C | Eb | G | Bb | D | F | A | C7 |
| D | F | A | C1 | E | G | B | D | F# | A | C# | E | G# | B | D# | F# | Bb | Db | F | Ab | C | Eb | G | Bb | D |
| Eb | G | Bb | D | F | A | C2 | E | G | B | D | F# | A | C# | E | G# | B | D# | F# | Bb | Db | F | Ab | C | Eb |
| F | Ab | C | Eb | G | Bb | D | F | A | C3 | E | G | B | D | F# | A | C# | E | G# | B | D# | F# | Bb | Db | F |
| F# | Bb | Db | F | Ab | C | Eb | G | Bb | D | F | A | C4 | E | G | B | D | F# | A | C# | E | G# | B | D# | F# |
| G# | B | D# | F# | Bb | Db | F | Ab | C | Eb | G | Bb | D | F | A | C5 | E | G | B | D | F# | A | C# | E | G# |
| A | C# | E | G# | B | D# | F# | Bb | Db | F | Ab | C | Eb | G | Bb | D | F | A | C6 | E | G | B | D | F# | A |
| B | D | F# | A | C# | E | G# | B | D# | F# | Bb | Db | F | Ab | C | Eb | G | Bb | D | F | A | C7 | E | G | B |
| C1 | E | G | B | D | F# | A | C# | E | G# | B | D# | F# | Bb | Db | F | Ab | C | Eb | G | Bb | D | F | A | C8 |

Figure 6: Combination of rows with +2, +1 semitones sequence bottom to top, and added intermediate semitone interval notes on major-chord-forming-notes, as referenced on, but not limiting Claim #1.

| | | | | | | | | | | | | | | | | | | | | | | | | |
|---|---|---|---|---|---|---|---|---|---|---|---|---|---|---|---|---|---|---|---|---|---|---|---|---|
| C1 | E | G | B | D | F# | A | C# | E | G# | B | D# | F# | Bb | Db | F | Ab | C | Eb | G | Bb | D | F | A | C8 |
| B | D | F# | A | C# | E | G# | B | D# | F# | Bb | Db | F | Ab | C | Eb | G | Bb | D | F | A | C7 | E | G | B |
| A | C# | E | G# | B | D# | F# | Bb | Db | F | Ab | C | Eb | G | Bb | D | F | A | C6 | E | G | B | D | F# | A |
| G# | B | D# | F# | Bb | Db | F | Ab | C | Eb | G | Bb | D | F | A | C5 | E | G | B | D | F# | A | C# | E | G# |
| F# | Bb | Db | F | Ab | C | Eb | G | Bb | D | F | A | C4 | E | G | B | D | F# | A | C# | E | G# | B | D# | F# |
| F | Ab | C | Eb | G | Bb | D | F | A | C3 | E | G | B | D | F# | A | C# | E | G# | B | D# | F# | Bb | Db | F |
| Eb | G | Bb | D | F | A | C2 | E | G | B | D | F# | A | C# | E | G# | B | D# | F# | Bb | Db | F | Ab | C | Eb |
| D | F | A | C1 | E | G | B | D | F# | A | C# | E | G# | B | D# | F# | Bb | Db | F | Ab | C | Eb | G | Bb | D |
| C0 | E | G | B | D | F# | A | C# | E | G# | B | D# | F# | Bb | Db | F | Ab | C | Eb | G | Bb | D | F | A | C7 |

Figure 7: Combination of rows with +2, +1 semitones sequence bottom to top with added intermediate semitone interval notes outside the rows as referenced on, but not limiting Claim #3.

| | | | | | | | | | | | | | | | | | | | | | | | |
|---|---|---|---|---|---|---|---|---|---|---|---|---|---|---|---|---|---|---|---|---|---|---|---|
| C1 | E | G | B | D | F# | A | C# | E | G# | B | D# | F# | Bb | Db | F | Ab | C | Eb | G | Bb | D | F | A | C8 |
| B | D | F# | A | C# | E | G# | B | D# | F# | Bb | Db | F | Ab | C | Eb | G | Bb | D | F | A | C7 | E | G | B |
| A | C# | E | G# | B | D# | F# | Bb | Db | F | Ab | C | Eb | G | Bb | D | F | A | C6 | E | G | B | D | F# | A |
| G# | B | D# | F# | Bb | Db | F | Ab | C | Eb | G | Bb | D | F | A | C5 | E | G | B | D | F# | A | C# | E | G# |
| F# | Bb | Db | F | Ab | C | Eb | G | Bb | D | F | A | C4 | E | G | B | D | F# | A | C# | E | G# | B | D# | F# |
| F | Ab | C | Eb | G | Bb | D | F | A | C3 | E | G | B | D | F# | A | C# | E | G# | B | D# | F# | Bb | Db | F |
| Eb | G | Bb | D | F | A | C2 | E | G | B | D | F# | A | C# | E | G# | B | D# | F# | Bb | Db | F | Ab | C | Eb |
| D | F | A | C1 | E | G | B | D | F# | A | C# | E | G# | B | D# | F# | Bb | Db | F | Ab | C | Eb | G | Bb | D |
| C0 | E | G | B | D | F# | A | C# | E | G# | B | D# | F# | Bb | Db | F | Ab | C | Eb | G | Bb | D | F | A | C7 |

Figure 8: Combination of rows with a +1, +1, +1, +0 semitones sequence bottom to top, as referenced in, but not limiting Claim #5.

| | | | | | | | | | | | | | | | | | | | | | | | |
|---|---|---|---|---|---|---|---|---|---|---|---|---|---|---|---|---|---|---|---|---|---|---|---|
| C1 | E | G | B | D | F# | A | C# | E | G# | B | D# | F# | Bb | Db | F | Ab | C | Eb | G | Bb | D | F | A | C8 |
| B | D | F# | A | C# | E | G# | B | D# | F# | Bb | Db | F | Ab | C | Eb | G | Bb | D | F | A | C7 | E | G | B |
| A | C# | E | G# | B | D# | F# | Bb | Db | F | Ab | C | Eb | G | Bb | D | F | A | C6 | E | G | B | D | F# | A |
| G# | B | D# | F# | Bb | Db | F | Ab | C | Eb | G | Bb | D | F | A | C5 | E | G | B | D | F# | A | C# | E | G# |
| F# | Bb | Db | F | Ab | C | Eb | G | Bb | D | F | A | C4 | E | G | B | D | F# | A | C# | E | G# | B | D# | F# |
| F | Ab | C | Eb | G | Bb | D | F | A | C3 | E | G | B | D | F# | A | C# | E | G# | B | D# | F# | Bb | Db | F |
| Eb | G | Bb | D | F | A | C2 | E | G | B | D | F# | A | C# | E | G# | B | D# | F# | Bb | Db | F | Ab | C | Eb |
| D | F | A | C1 | E | G | B | D | F# | A | C# | E | G# | B | D# | F# | Bb | Db | F | Ab | C | Eb | G | Bb | D |
| C0 | E | G | B | D | F# | A | C# | E | G# | B | D# | F# | Bb | Db | F | Ab | C | Eb | G | Bb | D | F | A | C7 |

Figure 9: Combination of rows with +2 semitones sequence top to bottom, with added intermediate semitone interval notes, as referenced on, but not limiting Claim #8.

| | | | | | | | | | | | | | | | | | | | | | | | |
|---|---|---|---|---|---|---|---|---|---|---|---|---|---|---|---|---|---|---|---|---|---|---|---|
| D | F# | A | C# | E | G# | B | D# | F# | B | Db | F | Ab | C | Eb | G | Bb | D | F | A | C5 | E | G | B |
| E | G# | B | D# | F# | B | Db | F | Ab | C | Eb | G | Bb | D | F | A | C4 | E | G | B | D | F# | A | C# |
| F# | B | Db | F | Ab | C | Eb | G | Bb | D | F | A | C3 | E | G | B | D | F# | A | C# | E | G# | B | D# |
| Ab | C | Eb | G | Bb | D | F | A | C2 | E | G | B | D | F# | A | C# | E | G# | B | D# | F# | B | Db | F |
| Bb | D | F | A | C1 | E | G | B | D | F# | A | C# | E | G# | B | D# | F# | B | Db | F | Ab | C | Eb | G |
| C0 | E | G | B | D | F# | A | C# | E | G# | B | D# | F# | B | Db | F | Ab | C | Eb | G | Bb | D | F | A |

Figure 10: Combination of rows with +5 semitones sequence bottom to top, with added intermediate notes, as referenced on, but not limiting Claim #12.

| | | | | | | | | | | | | | | | | |
|---|---|---|---|---|---|---|---|---|---|---|---|---|---|---|---|---|
| E | G# | B | D# | F# | B | Db | F | Ab | C | Eb | G | Bb | D | F | A | C8 |
| B | D# | F# | B | Db | F | Ab | C | Eb | G | Bb | D | F | A | C7 | E | G |
| F# | B | Db | F | Ab | C | Eb | G | Bb | D | F | A | C6 | E | G | B | D |
| Db | F | Ab | C | Eb | G | Bb | D | F | A | C5 | E | G | B | D | F# | A |
| Ab | C | Eb | G | Bb | D | F | A | C4 | E | G | B | D | F# | A | C# | E |
| Eb | G | Bb | D | F | A | C3 | E | G | B | D | F# | A | C# | E | G# | B |
| Bb | D | F | A | C2 | E | G | B | D | F# | A | C# | E | G# | B | D# | F# |
| F | A | C1 | E | G | B | D | F# | A | C# | E | G# | B | D# | F# | B | Db |
| C0 | E | G | B | D | F# | A | C# | E | G# | B | D# | F# | B | Db | F | Ab |

Figure 11: Combination of rows with +2, +1 semitones sequence bottom to top, staggered, with added intermediate semitone interval notes on minor-chord-forming-notes, as referenced, but not limiting Claim #18.
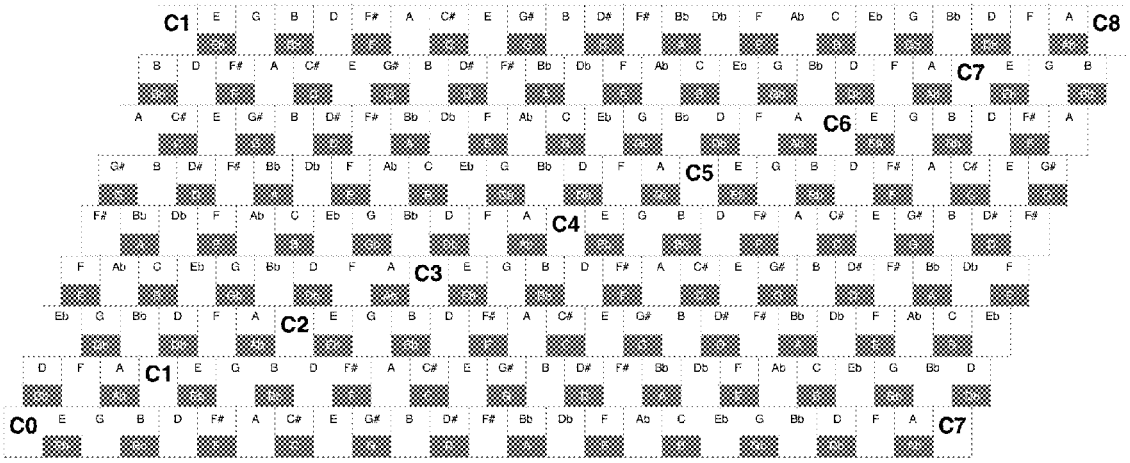

SIMPLE MUSIC—NEXT GENERATION KEYBOARD

CROSS-REFERENCE TO RELATED APPLICATIONS

Provisional Patent No. 62/058,579

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

Simple Music pertains to the music field, a field built upon musical instruments circumscribed to their physical boundaries. These musical instruments produce sound through vibrations at different frequencies constrained by the instruments themselves. The representations of these frequencies, rather than geometrical and mathematically simple, are the result of complex vibration patterns.

The Keyboard, an instrument intended to accommodate for the sound of hundreds of instruments, still resembles the pattern of one of these physically constrained instruments, the piano. Like the piano it follows a chromatic pattern that includes a consecutive series of twelve distinctive musical notes, which loops at increased pitches (FIG. 1). No matter what keynote is used, it does not provide prioritization of notes on its pattern, but is limited to keeping including all notes on its sequence, thus forcing the music player to get around skipping, and ensuring not to accidentally include unwanted notes during his musical play. Although this difficulty still happens even with the keynote C, which often uses only the white keys of the keyboard, it gets much more complex for the prospective musician when the other eleven notes are selected as main notes.

Simple Music provides an alternative arrangement of notes that facilitates learning and playing music to both musicians and non-musicians. An initial version of an alternate arrangement of notes was made public on August 2010 in the form of an application for mobile devices for proof of concept. The claims presented under this invention application represent newer versions focused on providing for further musical note arrangement options including added use and versatility to this concept.

BRIEF SUMMARY OF THE INVENTION

The substance of Simple Music is to provide for ultimate arrangements of musical notes that facilitate the learning and playing of western traditional music. Thus, Simple Music focuses on the relevance of surrounding notes relative to a selected main note or keynote. When compared to a piano or keyboard, it removes these less relevant sounds to each note, but still includes them close by in additional rows of notes added above and below for their use as required.

In iterating for this ultimate array of notes, the basis of the pattern itself for its rows of notes is found to be very simple in construction following a continuous +4, +3 semitones sequence of the chromatic twelve-note pattern, combined with providing for several rows of notes, similar to string instruments. Playing any set of three consecutive notes forms alternate major and minor chords, the note combinations most commonly used in western traditional music. As opposed to the Piano, the Guitar and most other musical instruments, playing patterns remain exactly the same as the player changes the main note of a musical play. With the Simple Music note arrangement options learning and performing music becomes much simpler.

BRIEF DESCRIPTION OF THE SEVERAL VIEWS OF THE DRAWING

FIG. 1—A representation of the western tonal music chromatic pattern of twelve distinct tones. Each step or interval between two adjacent notes is referred to as a half-step or semitone.

FIG. 2—The fundamental row of the Simple Music notes array, which follows an alternating +4, +3 semitones pattern, instead of the chromatic single semitones pattern presented on FIG. 1. This sequence represents a major third-minor third cycle loop row as it cycles between major and minor thirds and loops at every 24 keys. Rows following this sequence are to be referred as fundamental rows or major third-minor third cycle loop rows for the Simple Music note arrays.

FIG. 3—The identification of the sequential formation of major and minor chords in the fundamental rows of the Simple Music notes array. Alternating major and minor chords are always formed departing from any note in the sequence. Each note in the row is to be referred to as either a major-chord-forming-note or a minor-chord-forming-note when combined with their following two notes they form either major or minor chords respectively.

FIG. 4—A representation of the result of combining three or more fundamental rows, where rows are accommodated such that the notes of most relevant importance in western music end up surrounding a given selected key. In this case the key arbitrarily selected is the western music note C, and it is surrounded by the diatonic scale notes C-D-E-F-G-A-B, plus its $7^{th}$, Bb, together with their respective formed chords.

FIG. 5—Example possible outcome of referenced, but not limiting claim #15. Sample combination of rows as in FIG. 4, extended, combining rows such that it results in an ascending pitch from top to bottom, left to right, with alternating +2, +1 semitones steps between adjacent notes in the rows after major-chord-forming-notes and minor-chord-forming-notes respectively. A reference note is set arbitrarily as the array loops every 24 notes on the rows and every 8 rows on the columns. The size of the array is also set arbitrarily.

FIG. 6—Example possible outcome of referenced, but not limiting claim #1. Same combination of fundamental rows as in FIG. 5, but with ascending pitch in the bottom to top direction, left to right, and with the addition of intermediate notes inside the fundamental rows themselves, such that columns follow chromatic scales in the bottom to top direction. Intermediate notes are located only within major-chord-forming-notes, added within at their top or bottom portions, as +1 semitones notes of these notes. A reference note is set arbitrarily as the array loops every 24 notes on the rows and every 8 rows on the columns. The size of the array is also set arbitrarily.

FIG. 7—Example possible outcome of referenced, but not limiting claim #3. Sample combination of rows with a +2, +1 semitones with ascending pitch in the bottom to top vertical direction, left to right, as in FIG. 6, but with intermediate semitone interval notes located outside the rows as separate intermediate rows, with empty spaces where no intermediate notes are needed as the semitone interval between rows is exactly 1. Different to FIG. 6, intermediate notes form separate rows. As in previous figures a reference note is set arbitrarily as the array loops every 24 notes on the rows and every 16 rows vertically including these intermediate rows. The size of the array is also set arbitrarily.

FIG. 8—Example possible outcome of referenced, but not limiting claim #5. Sample combination of all +4, +3 major third-minor third cycle loop rows with vertical notes following a +1, +1, +1, +0 semitones cycle with ascending pitch in the bottom to top vertical direction, left to right, following cycles of two consecutive major-chord-forming-notes and two consecutive minor-chord-forming-notes with increasing +1 semitone intervals between adjacent rows, but a +0 no interval from the second minor-chord -forming-note to the first major-chord-forming-note of this cycle in the ascending pitch direction. As in previous figures a reference note is set arbitrarily as the array loops every 24 notes on the rows and every 16 rows vertically. The size of the array is also set arbitrarily.

FIG. 9—Example possible outcome of referenced, but not limiting claim #8. Sample combination of rows following a +4, +3 major third-minor third cycle loop rows with a +2 semitones with ascending pitch in the top to bottom vertical direction, left to right, with added intermediate semitone interval notes located inside the rows themselves, in this example placed only within the alternating notes that form minor chords when combined to their following two notes in the rows. As in previous figures a reference note is set arbitrarily as the array loops horizontally and vertically.

FIG. 10—Example possible outcome of referenced, but not limiting claim #12. Sample combination of rows with a +5 semitones with ascending pitch in the bottom to top vertical direction, left to right, with added intermediate semitone interval notes located inside the rows themselves, in this example placed only within the alternating notes that form minor chords when combined to their following two notes in the rows. As in previous figures a reference note is set arbitrarily as the array loops horizontally and vertically.

FIG. 11—Example possible outcome of referenced, but not limiting claim #18. Sample combination of rows with a +2, +1 semitones, as in FIG. 5, but with ascending pitch in the bottom to top vertical direction, left to right, with added intermediate semitone interval notes located inside the rows themselves, placed within the alternating notes that form minor chords when combined to their following two notes in the row as described in FIG. 3, and rows staggered to the right with respect to their previous rows in the bottom to top ascending pitch direction, referring to staggered as slid to either side such that the vertical alignment of the major third-minor third cycle rows results inclined to either left or right side.

DETAILED DESCRIPTION OF THE INVENTION

Music is the combination of notes with time. Notes combine to form chords, which at the same time combine to play along songs and melodies. Musical instruments focus in providing for playing individual notes, mostly in chromatic order, as the physics of note frequencies dictate. The substance of Simple Music is to provide for a new arrangement of notes that rather than focusing on providing for playing individual notes, focuses on providing for playing chords with ease, and on the relevance of these chords to the notes they surround in order to facilitate the learning and playing of western traditional music. Thus, Simple Music departs itself from the western tonal chromatic twelve-note pattern followed by the piano and guitar strings, removing identified less relevant notes to each previous note in the left to right direction for purposes of forming chords, but still including these removed notes close by in added rows, for their use as required.

In iterating for this ultimate array of notes, the basis of the pattern for the rows of notes is found to be very simple in construction following a continuous +4, +3 half notes sequence of the chromatic twelve note pattern, following the half steps or semitones, which names a half step or semitone as the interval between two adjacent notes in the twelve-note chromatic pattern. This chromatic pattern is referenced in FIG. 1. FIG. 2 shows this note sequence choosing "C" arbitrarily as the first note of the pattern. Playing any set of three consecutive notes forms alternating major and minor chords of the first note in the three-note sequence, the sets of notes most commonly used in western traditional music and music theory. In FIG. 3 these sequential formation of major and minor chords is presented. Following the note "A" at the end of this sequence the pattern continues to repeat in "C"; thus, the pattern is infinite and the beginning and end is not predetermined but rather chosen arbitrarily as long as the sequence is followed. The invention under this application does not claim this pattern for the rows, as it has been used before in music, mainly for purposes of describing music theory as it refers to the relationship of the thirds of notes in forming chords. This row pattern is to be referred hereafter as a major third-minor third cycle loop row or fundamental row, as it cycles between major and minor thirds of each previous note, and it loops at every 24 notes. The invention under this application rather focuses on proposed combinations of three or more rows following this major third-minor third cycle loop together with add-on intermediate notes within or between rows, hereafter referred to as intermediate-notes, and intermediate-note rows, to generate a playable virtual, digital, or physical musical instrument.

Simple Music sets major third-minor third cycle loop rows in top or below each other manipulating the position of the notes relative to adjacent rows. In iterating for this alignment of notes, several sequences for the resulting vertical combination of notes are found optional. These vertical sequence options include 1) a +2 semitones step in the vertical direction with alternating all major-chord-forming notes and all minor-chord-forming-notes, referring to major and minor chord forming notes as those that form their respective major and minor chords when combined to their following two notes of the sequence in their respective rows, 2) a +5 semitones step in the vertical direction with alternating all major-chord-forming notes and all minor-chord-forming-notes, 3) a +2, +1 semitones cycle with alternating major-chords-forming-notes and minor-chord-forming-notes in all vertical direction note sequences, and 4) a +1, +1, +1, +0 semitone cycle with alternating two major-chords-forming-notes and two minor-chord-forming-notes in all vertical direction note sequences. FIG. 4 shows an example of this likely combination of rows of notes where the main chords of the popular western music major scale relative to a given keynote end up adjacent to each other. FIG. 5, an extended version of the combination of rows in FIG. 4, further shows the versatility of this arrangement of notes as the relationship of notes to each other repeats for every single note, different from a piano or music keyboard where the construction of chords and visual construction of note sequences differ from note to note.

Ultimately and even more comprehensively, to make up for missing notes between rows resulting from the +2 semitones steps in the +2, +1 semitone cycle, +2 semitone steps and even on the +5 semitones steps, intermediate notes are added, thus completing all notes of the chromatic sequence in the resulting vertical note sequences, except on the 5+semitone steps, although still obtainable diagonally, while preserving the major third-minor third cycle loop in the rows. FIG. 6, FIG. 7, FIG. 9, FIG. 10 show options for incorporating these intermediate notes. FIG. 8 shows the approach of incorporating intermediate full rows, following the same major third-minor third cycle loop, with a +1, +1, +1, +0 semitones cycle in the resulting notes of the columns, with alternating two consecutive major-chord-forming-notes and two consecutive minor-forming-chord-notes with the +0 semitone interval step between minor-forming-chord-notes and the following adjacent major-chord-forming-note.

The versatility of these arrangements of notes is further extended by providing for mirroring of the notes in the vertical direction depending on the pitch preference. Rows can be set such that the pitch of subsequent rows in the vertical direction increases upwards or downwards in the resulting columns.

Rows also provide for staggered arrangements up to shifting one full note to either left or right side relative to previous rows. Among other, staggering up to one full note shifting of increasing pitch rows to the left provides for easy glissing from the fifth of a given note to its next octave, and staggering up to one full note shifting of increasing pitch rows to the right provides for easier right hand music scales playing and an alignment of notes closer to a musical score. Staggering also provides for replicating the resulting array options on computer keyboards, providing for a midi controller or any other technology to play music with the computer keyboard itself, where keys are usually staggered.

These resulting note arrangements provide for easy chord playing for not only major and minor chord triads, but also diminished and augmented, referred collectively as chordal quality in western traditional music. Finally these arrangements also provide for innumerable combinations of chords to include, not only triads, but also tetrads, pentads, and hexads with four, five and six distinct notes respectively, encompassing the most commonly used and predominant chords in western traditional music. Thus, these resulting note pattern options represent complete and new musical "Boards of Keys" not only allowing for non-instrument-skilled individuals to play music, but also for professional musicians to easily transmit music theory into physical means, when incorporated into a digital or physical musical instrument, or board of keys.

I claim:

1. A musical instrument or musical keyboard, physical, electronic, or virtual as in touch and computer devices, with its own sounds and/or note signals output such as midi controllers, comprising a combination of two or more rows of keys following a +4, +3, otherwise +3, +4 chromatic scale semitones pattern, with these rows are squared or staggered with respect to each other, with intermediate keys of equal or smaller size between adjacent rows, with these intermediate keys of +1 chromatic scale semitone steps relative to their key below or above, with these intermediate keys located directly above, within, as inclusive functional sections of, or below at least one key that forms a major chord when combined to their following two keys left to right.

2. The musical instrument as of claim 1, with its intermediate keys as described in claim 1, shifted to either side up to two full key widths of the primary +4, +3, otherwise +3, +4 chromatic scale semitones patterned rows.

3. The musical instrument as of claim 1, with additional intermediate keys of equal or smaller size between adjacent rows, with these intermediate keys of −1 chromatic scale semitone steps relative to their keys below or above, with these intermediate keys located directly above, within, as inclusive functional sections of, or below at least one key that forms a minor chord when combined to their following two keys left to right.

4. The musical instrument as of claim 3, with all its intermediate keys as described in claim 1 and claim 3, shifted to either side up to two full key widths of the primary +4, +3, otherwise +3, +4 chromatic scale semitones patterned rows.

5. A musical instrument or musical keyboard, physical, electronic, or virtual as in touch and computer devices, with its own sounds and/or note signals output such as midi controllers, comprising a combination of two or more rows of keys following a +4, +3, otherwise +3, +4 chromatic scale semitones pattern, with these rows squared or staggered with respect to each other, with intermediate rows of keys of equal or smaller size between these adjacent rows, with these intermediate keys following a +3, +2, +2, otherwise +2, +2, +3, otherwise +2, +3, +2 chromatic scale semitone pattern, with these intermediate keys located directly above, within, as inclusive functional sections of, or below at least one key width portion of the rows that follow a +4, +3, otherwise +3, +4 chromatic scale semitones pattern.

6. A musical instrument or musical keyboard, physical, electronic, or virtual as in touch and computer devices, with its own sounds and/or note signals output such as midi controllers, comprising a combination of two or more rows of keys following a +4, +3, otherwise +3, +4 chromatic scale semitones pattern, with these rows squared or staggered with respect to each other, with the only exceptions of rows squarely aligned such that columns form a vertical +2, +1, otherwise +1, +2 chromatic scale semitone steps bottom to top, and rows squarely aligned or staggered with alternate vertical +1, +0 and +2, −1 chromatic scale semitone steps bottom to top.

7. The musical instrument as of claim 6 with intermediate keys of equal or smaller size between adjacent rows, with these intermediate keys of −1 chromatic scale semitone steps relative to their key above or below, with these intermediate keys located directly above, within, as inclusive functional sections of, or below at least one key that forms a minor chord when combined to their following two keys left to right.

8. The musical instrument as of claim 7, with its intermediate keys as described in claim 7, shifted to either side up to two full key widths of the primary +4, +3, otherwise +3, +4 chromatic scale semitones patterned rows.

* * * * *